United States Patent [19]

Rutz

[11] 4,033,237

[45] July 5, 1977

[54] HYDROSTATIC PISTON MACHINE HAVING SMALL CLEARANCES BETWEEN BEARING SURFACES

[75] Inventor: Peter Rutz, Winterthur, Switzerland

[73] Assignee: Sulzer Brothers Limited, Winterthur, Switzerland

[22] Filed: Oct. 29, 1974

[21] Appl. No.: 518,983

[30] Foreign Application Priority Data

Nov. 2, 1973 Switzerland ..... 15420/73

[52] U.S. Cl. ..... 91/484; 308/DIG. 4; 91/486; 91/498

[51] Int. Cl.[2] ..... F01B 13/06; F16C 35/00

[58] Field of Search ..... 91/482, 484, 486–488, 91/496, 491, 494, 497, 498; 308/DIG. 4

[56] References Cited

UNITED STATES PATENTS

| | | | |
|---|---|---|---|
| 2,689,531 | 9/1954 | Benedik | 91/496 |
| 2,827,859 | 3/1958 | Crane | 91/497 |
| 3,148,627 | 9/1964 | Muller | 91/494 |
| 3,211,105 | 10/1965 | Bush et al. | 91/482 |
| 3,468,263 | 9/1969 | Niemiec | 91/499 |
| 3,545,338 | 12/1970 | Lucien | 91/507 |
| 3,777,624 | 12/1973 | Dixon | 91/488 |
| 3,935,794 | 3/1976 | Rumsey | 91/488 |
| 3,943,826 | 3/1976 | Kita | 91/491 |

*Primary Examiner*—William L. Freeh
*Attorney, Agent, or Firm*—Kenyon & Kenyon, Reilly, Carr & Chapin

[57] ABSTRACT

A floating bearing ring is disposed between each bearing surface of the fixed pin and the guide member for the pistons and in spaced relation to each. The clearance of the bearing rings from the pin bearing surfaces is less than the clearance of the bearing rings from the guide member. Upon heating of the pin, the bearing rings simultaneously heat up to the same temperature to maintain their clearance. This prevents seizing of the bearing rings and, in turn, the guide member on the pin during use.

6 Claims, 1 Drawing Figure

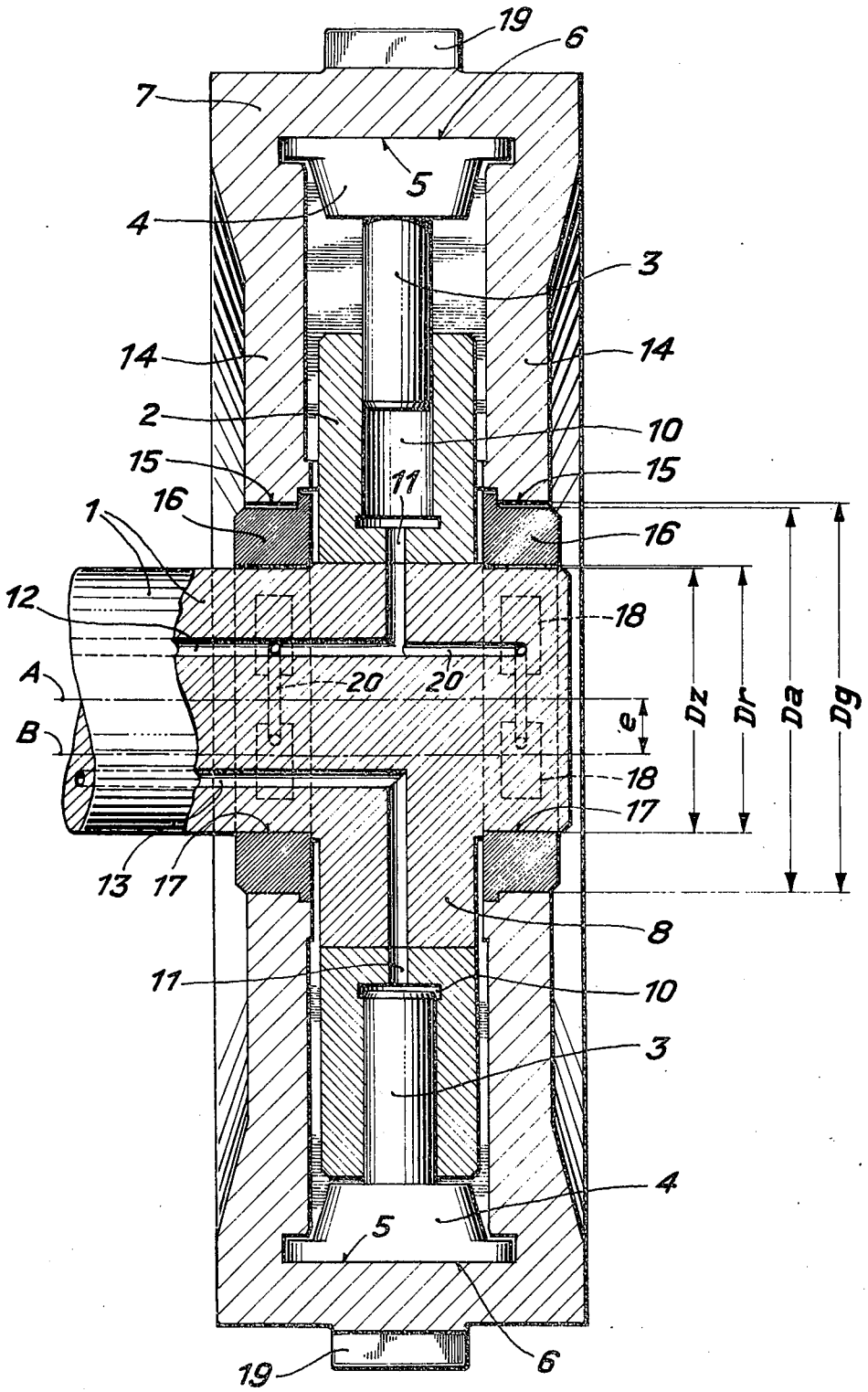
19
6
7
5
4
3
14
14
2
10
15
11
15
16
1
16
12
18
A
20
20
Dz
Dr
Da
Dg
e
B
18
17
13
17
8
11
10
3
4
5
6
19

HYDROSTATIC PISTON MACHINE HAVING SMALL CLEARANCES BETWEEN BEARING SURFACES

This invention relates to a hydrostatic piston machine.

Hydrostatic piston machines are known to have a cylinder block which is rotatable about a pin or pivot and pistons which are guided in the periphery of the cylinder block and which are distributed radially of the pin or pivot. The outer end of each piston usually has a foot with a plane bearing surface guided along a plane guide surface of a guide member. The guide surfaces are, in turn, disposed tangentially to a circular cylindrical surface which is eccentric of the axis of the cylinder block, the guide member being mounted to rotate about the axis of the circular cylindrical surface on at least one bearing surface of a pin or pivot. The bearing surface is also usually provided with a lubricant feed. A piston machine of this kind is disclosed, for example, in Swiss Patent Specification 540,427.

A piston machine of this kind has also been known in which the guide member is formed with bores by means of which the guide member is mounted on a pin provided with a lubricant feed, preferably via lubricating pockets after the style of a hydrostatic bearing. In a machine of this kind, particularly if intended for high pressures, the clearance between the pin and the bore of the guide member must be kept at a minimum to avoid excessive losses due to escaping oil. However, a difficulty arises in that the pin generally heats up much more than the guide member during operation so that there is a risk of the bearing seizing.

Accordingly, it is an object of the invention to avoid seizing in a hydrostatic piston machine.

It is another object of the invention to reduce the amount of hydraulic pressure medium loss in a hydrostatic piston machine to a minimum.

It is another object of the invention to utilize relatively small bearing clearances in a hydrostatic piston machine.

It is another object of the invention to reduce wear in a hydrostatic piston machine.

Briefly, the invention provides a hydrostatic piston machine which has a pin including at least one bearing surface and a piston guide member rotatably mounted about the pin with a bearing ring between the bearing surface and guide member and in spaced relation to the bearing surface and guide member. The bearing ring is disposed with a clearance from the pin bearing surface which is of less dimension that the clearance from the guide member. In addition, a means is provided for feeding lubricant to the bearing surface of the pin.

In a construction of this kind, the pin, or pivot, is surrounded by a bearing ring of small mass which is, therefore, rapidly heated up together with the pin during operation to the same temperature. The resulting thermal expansion is rendered possible by the greater clearance of the ring in the bore of the guide member. Since the outer surface of the ring and the inner surface of the bore of the guide member are lubricated to a lesser degree and have a larger diameter, there is a greater moment of friction between them than between the ring and the pin. The ring therefore tends to rotate relative to the pin and remain stationary in the guide member although relatively small movements are possible.

The pin bearing surface may be provided in a manner known per se with lubricating pockets for a hydrostatic lubricating system. However, in the case of relatively low pressure, hydro-dynamic lubrication may be provided.

In a simple embodiment, the pin bearing surface is constructed eccentrically of a pin portion about which a cylinder block for movable pistons is rotatable. If, however, the eccentricity of the bearing surface in relation to this pin portion is to be adjustable, the bearing surface may be constructed on some other part.

The pin, guide member and bearing ring may preferably all consist of a material having the same coefficient of thermal expansion. This creates simple conditions for manufacture and operation. The ring may be made from the same material, since the ring assumes substantially the same temperature as the pin during operation. Hence, the expansion of the ring is equal to the expansion of the pin so that the clearance remains practically unchanged.

These and other objects and advantages of the invention will become more apparent from the following detailed description and appended claims taken in conjunction with the accompanying drawing in which:

The single FIGURE illustrates an axial section of a hydrostatic piston machine according to the invention.

As shown in the drawing, the hydrostatic piston machine has a pin or pivot 1 about which a cylinder block 2 is rotatable. The pin 1 is secured in a housing (not shown) on a longitudinal axis A and includes an eccentric portion 8 about which the cylinder block 2 is rotatable. This portion 8 has an axis B which is eccentric to the axis A.

The cylinder block 2 includes a plurality of chambers 10 in which pistons 3 are movably mounted. Each piston 3 has an outer end at which a foot 4 with a plane bearing surface 5 is mounted.

A guide member 7 having a plurality of plane guide surfaces 6 disposed tangentially of a circular cylinder having an axis coincident with axis A is mounted on the pin 1 about the cylinder block 2. As shown, each foot 4 is guided along a respective guide surface 6 of the guide member 7 in a known manner.

As is known, the eccentricity *e* of the axes A and B results in pumping movements of the pistons 3 in manner known per se on common rotation of the cylinder block 2 and guide member 7 about their axes A and B. This results in a change of volume of the cylinder chambers 10 which are adapted to be connected to conduits for a hydraulic pressure medium via ducts 11 in the cylinder block 2 and ducts 12, 13 in the pin 1, 8. The machine can operate either as a pump or as a motor depending upon the arrangement. The principle of operation of the machine is described in greater detail in the Swiss Patent Specification 540,427, so further detailed discussion is not believed to be necessary.

As will be apparent from the FIGURE, the guide member 7 has side walls 14 which are formed with bores 15 in which bearing rings 16 are disposed. The bearing rings 16 circumferentially enclose bearing surfaces 17 of the pin 1. Each ring 16 is disposed in spaced relation to the guide member 7 and a bearing surface 17. In addition, the clearance of each ring 16 from a bearing surface 17 is of less dimension than the clearance of each ring 16 from the guide member 7. As will also be apparent from the FIGURE, a means for feeding lubricant to the bearing surfaces 17 is provided.

This means includes pockets 18 in the bearing surfaces 17 for hydrostatic lubrication. These pockets 18 are connected in known manner to ducts 12, 13 via ducts 20. The guide member 7 is also provided with teeth 19 on the exterior to receive or deliver a torque.

The clearance between the bearing surface 17 and the bore of a ring 16 is defined by the difference between the diameters $Dz$ of the bearing sufrace 17 and $Dr$ of the ring 16. The clearance between the bearing ring 16 and the bore 15 is defined by the difference $Dg - Da$, where $Da$ is the outside diameter of a ring 16 and $Dg$ the inside diameter of a bore 15. The clearance $(Dr - Dz)$ is less than the clearance $(Dg - Da)$. The clearance $(Dr - Dz)$ may be the smallest clearance which, disregarding temperature differences, allows prefect hydrostatic mounting of the ring 16 on the bearing surface 17 of the pin 1. This results in minimum losses during operation due to escape of hydrostatic pressure medium, preferably oil, from the bearing. If the pin 1 heats up, the rings 16 assume practically the same temperature simultaneously. The clearance $(Dr - Dz)$ therefore remains unchanged. Only the clearance $(Dg - Da)$ decreases, and this clearance can be selected to have an appropriately large value. The perfect lubrication between the ring 16 and the pin 1 means that the ring 16 rotates about the pin 1 and not in the guide member 7. The ring 16 remains practically immovable in relation to the guide member 7 because the direction of the force by which the guide member 7 bears against the pin 1 is unchanged during operation.

In one embodiment of the machine with a 100 millimeter (mm) diameter for the pin 1 and the bearing surface 17, the clearance $(Dr - Dza0.02$ to 0.04 millimeters (mm) and the clearance $(Dg - Da)$ was 0.1 millimeters (mm).

Since the provision of the rings 16 eliminates the influence of thermal expansion, all the parts of the machine may be made from a material having the same thermal expansion, preferably steel. This gives advantages in production and wear.

It is to be noted that due to the clearances between the bearing rings 16 and the pin 1 and guide member 7, two types of lubrication occur. That is, a hydrostatic lubrication occurs between the rings 16 and the bearing surfaces 17 of the pin 1 while hydrodynamic lubrication occurs between the rings 16 and the bores 15 in the guide member 7. This latter hydrodynamic lubrication occurs during any movement of the rings 16 relative to the guide member 7. In a sense, during the formation of such a dual lubrication effect, the bearing rings 16 act as floating rings.

What is claimed is:

1. A hydrostatic piston machine comprising a pin having at least one bearing surface;

a guide member having a plurality of plane guide surfaces disposed tangentially of a circular cylinder having an axis, said guide member being rotatably mounted about said axis;

a cylinder block rotatably mounted on said pin;

a plurality of movably mounted pistons in said cylinder block disposed radially of said block, each said piston having a foot including a plane bearing surface guided on a respective guide surface of said guide member;

a bearing ring disposed between said guide member and said bearing surface in spaced relation to each of said guide member and bearing surface, said ring having a first clearance from said bearing surface of less dimension than a second clearance from said guide member, said first clearance being sufficient to allow hydrostatic mounting of said ring on said bearing surface and said second clearance being sufficient to permit thermal expansion of said pin and said bearing ring, said first and second clearances being dimensioned such that said bearing ring rotates relative to said pin and remains stationary in said guide member; and means including lubricating pockets in said bearing surface for feeding lubricant to said bearing surface to form a hydrostatic bearing.

2. A hydrostatic piston machine as set forth in claim 1 wherein said pin supports said cylinder block on a portion having an axis eccentric to the axis of said bearing surface.

3. In a hydrostatic piston machine having a pin including at least one bearing surface and a piston guide member rotatably mounted about said pin, a bearing ring disposed between said bearing surface and said guide member in spaced relation to said bearing surface and said guide member, said ring having a first clearance from said bearing surface of less dimension than a second clearance from said guide member, said first clearance being sufficient to allow hydrostatic mounting of said ring on said bearing surface and said second clearance being sufficient to permit thermal expansion of said pin and said bearing ring, said first and second clearances being dimensioned such that said bearing ring rotates relative to said pin and remains stationary in said guide member and means for feeding lubricant to said bearing surface to form a hydrostatic bearing, said means including lubricating pockets in said bearing surface.

4. In a hydrostatic piston machine as set forth in claim 5, wherein said bearing surface has a diameter of 100 millimeters, said first clearance has a radial dimension of from 0.02 to 0.04 millimeters and said second clearance has a radial dimension of 0.1 millimeters.

5. In a hydrostatic piston machine as set forth in claim 5, wherein said pin, bearing ring and guide member are made of a material having the same coefficient of thermal expansion.

6. A hydrostatic piston machine comprising a pin having at least one bearing surface;

a guide member having a plurality of plane guide surfaces disposed tangentially of a circular cylinder having an axis, said guide member being rotatably mounted about said axis;

a cylinder block rotatably mounted on said pin;

a plurality of movably mounted pistons in said cylinder block disposed radially of said block, each said piston having a foot including a plane bearing surface guided on a respective guide surface of said guide member;

a bearing ring disposed between said guide member and said bearing surface in spaced relation to each of said guide member and bearing surface, said ring having a first clearance from said bearing surface of less dimension than a second clearance from said guide member, said pin, bearing ring and guide member being made of a material having the same coefficient of thermal expansion; and means including lubricating pockets in said bearing surface for feeding lubricant to said bearing surface to form a hydrostatic bearing.

* * * * *

UNITED STATES PATENT AND TRADEMARK OFFICE

CERTIFICATE OF CORRECTION

PATENT NO. : 4,033,237

DATED : July 5, 1977

INVENTOR(S) : Peter Rutz

It is certified that error appears in the above-identified patent and that said Letters Patent are hereby corrected as shown below:

Column 3, line 8, "sufrace" should be --surface--.

Column 3, line 33, delete "(Dr - DZ ... milli-"

and insert --(Dr - Dz) was 0.02 to 0.04 milli- --

Column 4, line 36, "5" should be --3--.

Column 4, line 42, "5" should be --3--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*